United States Patent [19]

Dennison

[11] 4,050,766

[45] Sept. 27, 1977

[54] CORROSION-PROOF ELECTRICAL CONNECTOR ASSEMBLY

[75] Inventor: Graeme N. Dennison, Saanichton, Canada

[73] Assignee: Canada, Her Majesty the Queen in right of, as represented by the Minister of National Defence, Ottawa, Canada

[21] Appl. No.: 716,681

[22] Filed: Aug. 23, 1976

[30] Foreign Application Priority Data

Apr. 9, 1976 Canada ..... 249932

[51] Int. Cl.[2] ..... H01R 3/04

[52] U.S. Cl. ..... 339/117 P; 339/114

[58] Field of Search ..... 339/117 P, 117 R, 114, 339/118 R, 118 RY, 116 R, 116 C

[56] References Cited

U.S. PATENT DOCUMENTS

| | | | |
|---|---|---|---|
| 3,115,380 | 12/1963 | Kuehl et al. | 339/117 P |
| 3,877,775 | 4/1975 | Barlow et al. | 339/117 R |

*Primary Examiner*—Roy Lake
*Assistant Examiner*—DeWalden W. Jones
*Attorney, Agent, or Firm*—Michael M. Sakovich

[57] ABSTRACT

A housing enclosing an electrical connector has a capable open end through which the connector is received and a closed end having a passage that is sealably mounted in alignment with a through opening in a pressure hull. The connector is isolated from a marine environment by a dielectric liquid that fills the housing and immerses the connector. An end cap closes the open end of the housing to prevent loss and contamination of the liquid and includes a sealable opening through which a first member of the connector is admitted and locked to the housing. A feed-through portion of the connector mates with the cable end portion and is sealably fitted within the passage to provide an electrical connection through the hull. In an embodiment for in-line cable connections, the closed end carries a second member of the connector, corresponding to the first member, which is locked and sealed in the passage. A bleed hole in the housing communicates the environment to the liquid which pressurizes the housing and seals the connector to prevent corrosion. The bleed hole also operates to relieve pressure within the housing caused by expansion and contraction of the liquid due to environmental temperature changes.

23 Claims, 4 Drawing Figures

CORROSION-PROOF ELECTRICAL CONNECTOR ASSEMBLY

BACKGROUND OF THE INVENTION

This invention relates to electrical connector assemblies for use in a pressurized environment and more particularly to corrosion-proof electrical connector assemblies that are pressure balanced.

Marine connectors in the prior art commonly employ an electrically insulating, non-hygroscopic liquid as a filler compound to protect the conductors, wired connections and contacts from corrosion. This requires a connector housing having a liquid-tight inner chamber in which the connector is immersed in the compound. It is usual to completely fill the chamber and to manually pressurize same in order to prevent intrusion of water which may otherwise occur under normal marine environmental pressure conditions.

A problem with the foregoing marine connector structure is to provide a housing that is sufficiently strong to withstand the pressure contained within the chamber without leaking. Although such pressure may be relatively low, on the order of ten pounds per square inch, connections joined to the housing must be liquid-tight in order to prevent loss of the insulating liquid compound. In the event that some liquid loss should occur, the resulting void in the chamber would permit deleterious pressures and stresses to be applied to the connector within the chamber. Furthermore, the void could permit the intrusion of water from the marine environment which would cause corrosion of the connector. In either event, mechanical and/or electrical failure would likely ensue.

One way of overcoming the foregoing problem is by providing a connector housing of more substantial construction having robust liquid-tight connections that are less prone to develop leaks. An obvious disadvantage with this solution to the problem, however, is the additional cost of manufacture to produce a stronger underwater connector assembly.

In order to reduce the requirement of increased structural integrity in the connector housing, known housings have been manufactured with weakened portions that are flexibly responsive to marine environmental pressures in order to atuomatically pressure balance the connector assembly. The application of envornmental pressures to flexible portions of the connector housing compresses the substantially incompressible liquid in the chamber of the housing which counterbalances the forces of the applied environmental pressure. In this arrangement, it is also required that the chamber be completely filled with the substantially incompressible liquid. Otherwise, a remaining void would allow excessive flexing of the weakened portions in the connector housing under pressure which could lead to damage or premature failure of the assembly. For this reason, an excess of insulating liquid is used to pressurize the housing in order to obviate the presence of a void.

Obvious disadvantages with a marine connector having pressure responsive flexible portions in the housing are higher manufacturing costs and problems concerning manufacture and assembly. A significant difficulty, also, is that if flexible portions of the housing are made readily responsive to pressure variations, the mechanical integrity of the connector housing may be reduced. Abusive handling would therefore result in an easily damaged housing.

An ancillary problem in the marine connectors of the prior art is found when such connectors are used under test conditions where operational parameters of marine environment are manipulated in the extreme. Of particular significance is temperature since the filling compound of the prior art connectors is commonly petroleum jelly or some other like hydrocarbon substance that has a large coefficient of thermal expansion. The problem of leaks developing as a result of pressurizing a connector housing is further aggravated by a substantially higher internal pressure which is generated by the filler compound when it is subjected to higher temperatures.

SUMMARY OF THE INVENTION

According to the invention, means are provided to pressure balance an interior chamber of a corrosion-proof electrical connector assembly without resorting to structurally weakened, flexible portions in the connector housing. In this way, a more sturdy assembly is achieved.

According to another aspect of the invention, manual pressurization of the chamber within the housing is not required.

The invention also provides for pressurizing an electrically insulating liquid within the chamber to pressure seal the connector in order to prevent corrosion thereof by the environment, and also to relieve pressure within the chamber caused by expansion of the liquid due to heating from an environmental temperature increase.

The aforenoted disadvantages of the prior art may be overcome and the stated provisions of the invention achieved by recourse to the invention which relates to a housing for a corrosion-proof electrical connector having first and second mating members interconnecting electrical conductors in a pressurized environment. The housing includes container means having walls defining a substantially liquid-tight chamber adapted to receive the electrical connector, a closed end including a first passage therethrough for admitting a first conductor to the first mating member, and a cappable open end. A cap is provided to close the open end and includes a second passage therethrough for admitting a second conductor to the second mating member. Locking means are disposed on the cap and closed end for retaining the members in locked mating relation when the open end is capped. A dielectric liquid, substantially inert to the environment, fills the chamber to at least immerse the mating portions of the members, and means are provided to communicate the environment to the fluid for pressure balancing the housing and pressure sealing the immersed portions of the members.

The invention also relates to a corrosion-proof electrical connector assembly for interconnecting electrical conductors in a pressurized environment and comprises the aforenoted housing together with the electrical connector.

DESCRIPTION OF THE DRAWINGS

The invention will now be more completely described with reference to embodiments thereof shown, by way of example, in the accompanying drawings wherein.

DESCRIPTION OF THE ILLUSTRATED EMBODIMENTS

Figure 1:
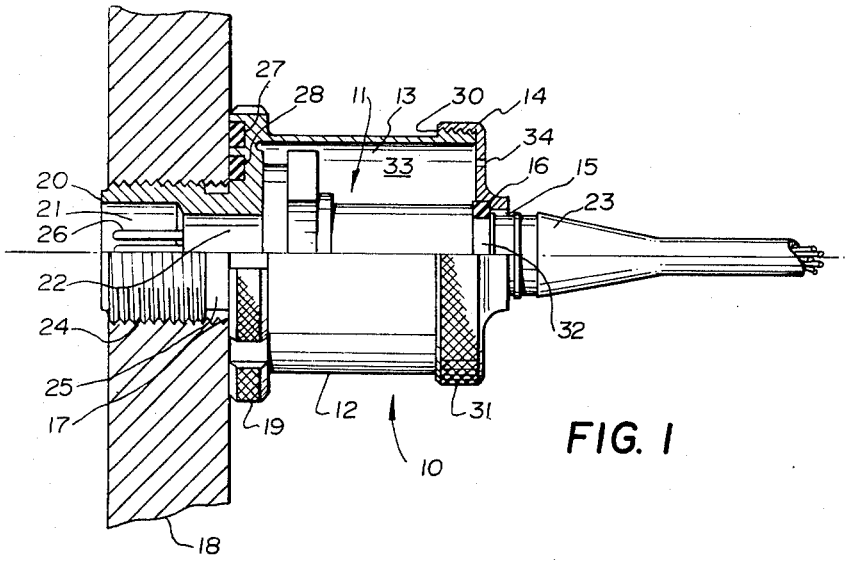
FIG. 1 is a side view, partly in section, of an electrical feed-through connector assembly, including mounting means, according to the invention.

A corrosion-proof electrical feed-through connector assembly 10 is shown in FIG. 1. A longitudinal portion of the assembly 10 is presented in section form in order to better illustrate the location of an electrical connector 11 that is disposed coaxially within a chamber 13 of a connector housing 12.

An end cap 14 is used to close off the open end of the housing 12 and includes a passage 15 through which a cable end 23 of the connector 11 is admitted to the chamber 13. It will be noted that an O-ring 16 is provided as means for locking the cable end 23 in the passage 15 to prevent the cable end from being inadvertently pulled out. Other forms of locking may be used, such as a split ring for example, depending on the conditions of the particular environment in which the connector assembly is placed. However, in the embodiment disclosed, it has been found that a conventional rubber O-ring is adequate, The walls of the housing 12 define the chamber 13 and include a closed end shown as a bulkhead end 17, opposite the open end, which is adapted to be mounted on a pressure hull 18 in a marine environment that may be either fresh or seawater. In either case, the assembly 10 is used to best advantage the deep marine applications where water leakage and corrosion is a problem with electrical connector assemblies of the prior art. The bulkhead end 17 includes a flange portion 19 which abuts a mounting surface of the hull 18, and further includes an outwardly extending spigot 20 through which a passage 21 extends from the chamber 13. It will be observed that the passage 21 is in coaxial alignment with the passage 15 and that a feed-through portion 22 of the connector 11, which may form an integral part of the end 17, is sealably fitted within the passage 21 to close it off from the chamber 13. The free end of the feed-through portion 22 terminates in electrical contacts 26 which are fitted to a mating electrical connector (not shown) on the dry side of the pressure hull 18, thus establishing an electrical connection through the hull. The other end of the portion 22 is separately connected to the cable end 23 and electrically mates with the end 23 inside the chamber 13. Furthermore, the cable end 23 is locked within the passage 15 and extends through to a connector cable 29.

In the embodiment of FIG. 1, the assembly 10 is mounted on the pressurized wet side of the hull 18 by means of threads 24 formed on the spigot 20. The spigot 20 fits coaxially into a through hole 25 which leads through the pressure hull 18 and communicates a free end of the feed-through portion 22 to the dry side of the hull 18 which is usually at a lower pressure. The threads 24 engage corresponding threads formed within the through hole 25. Sealing means in the form of two concentric O-rings 27 and 28 are provided between the flange portion 19 and the hull 18 to prevent water intrusion into the through hole 25.

The cap 14 is held in place by means of a threaded portion 30 disposed on the inner periphery of its rim 31 which engages a corresponding threaded portion on the outer periphery of the housing 12. It will be noted that the O-ring 16, which slides in a peripheral groove 32 formed in the cable end 23, operates also as a sealing arrangement as well as a means to lock the cable end 23 with the cap 14. The cable end 23 of the connector 11 is thus held in alignment with the feed-through portion 22 by means of the passage 15 and the O-ring 16. Therefore, when the cap 14 is threaded onto the open end of the housing 12, the cap draws together the two portions of the connector 11 and holds such portions in mating relation to maintain electrical contact.

The chamber 13 is filled with an electrically insulating, substantially non-hygroscopic compound 33 which substantially immerses the connector 11 and at least immerses the mating portions. Many viscous semi-solid hydrocarbon substances are suitable for the use in this application. However, a less viscous liquid is recommended which will not entrain air bubbles into which water may intrude. For example, oil may be used since it has good dielectric properties. Although the oil would preferably have a sufficiently high viscosity so that leakage problems will not arise, the seal formed by the O-ring 16 permits oils of relatively low viscosity to be used. Since the difference between a semi-solid and a liquid as referred to herein is merely a difference of viscosity, all references to liquids shall be understood to include such semi-solids.

Vaseline (trademark for a petroleum jelly product) is suggested as the filling compound 33 since its dielectric strength is high and its other physical properties are quite good. A suggested alternative filling compound is a fluorosilicon liquid such as Dow Corning FS-1265 liquid which also has suitable insulative properties. In order to prevent voids when filling the chamber 13 with VASELINE, it is heated to approximately 50° C, at which temperature it is a clear relatively thin liquid. The VASELINE is then poured into the chamber 13 to immerse the connector 11 and is allowed to solidify. After the filling operation, the cap 14 is threaded in place to prevent the compound 33 from being washed out or contaminated by floating debris.

The connector assembly 10 is pressure balanced by means of a bleed hole 34 disposed in the cap 14. Thus, the bleed hole 34 perforates the cap 14 and communicates the environmental marine pressure to the compound 33 within the chamber 13. The bleed hole 34 may be located in either the cap 14 or the housing 12, but it should be located to provide a maximum distance between it and the critical part of the connector 11, i.e., the interface between the mating portions. The pressurized compound then completely seals the connector 11 and isolates the connector from the marine environment. As a result, corrosion is effectively prevented and the useful life of the connector assembly is considerably extended. It has been determined that whereas leakage in commercially available marine electrical feed-through connectors occurs after approximately three months immersion in a marine environment, the effective life span of the connector assembly according to the present invention is substantially greater.

It will be observed that the bleed hole 34 provides an effective pressure balance means which does not require a housing that is especially adapted as in the underwater connectors of the prior art. Moreover, while the size and location of the bleed hole 34 is in the cap 14 is not especially critical, it should be located at a point which is furthest away from the interface of the mating portions. Furthrmore, the bleed hole 34 should be dimensioned to be compatible with the compound 33 so that surface tension of the compound will prevent leakage. The result is a corrosion-proof electrical connector assembly which is both economical to manufacture and convenient to use.

The connector assembly 10 may also be used with a connector that is formed in one piece, having a feed-through portion 22 with electrical contacts 26 extending into, and sealably fitted in the passage 21. A suitable arrangement for a sealable fit is provided by threads on the feed-through portion 22 and corresponding threads in the passage 21. This form of connector 11 would then be threaded directly into the passage 21. However, an adequate seal is required to prevent leakage of water or the compound 33 between the portion 22 and the passage 21. In this arrangement, the cap 14 would again be used to provide a restraining force on the cable end 23 to assist in keeping the connector 11 in position.

Figure 2:
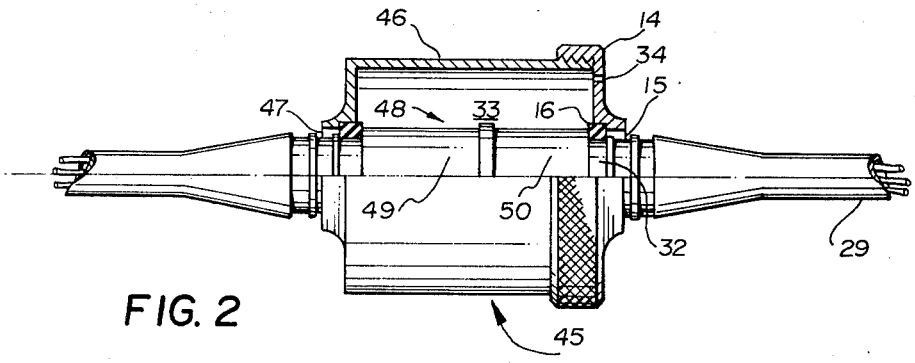
FIG. 2 is a side view, partly in section, of an in-line electrical connector assembly according to the invention.

A further embodiment of the invention is shown in FIG. 2. This embodiment comprises an in-line corrosion-proof electrical connector assembly 45 which is similar in many respects to the feed-through connector assembly 10 of FIG. 1. The similarities are readily seen since a portion of the assembly 45 is presented in section form. In particular, it will be noted that one end of the assembly 45 is identical with the assembly 10, both of which employ a cap 14. The end opposite the cap 14 forms an integral part of a housing 46, but it is like the cap 14 in that it includes a passage 47 that is identical to the passage 15. As illustrated, a connector 48 forms part of the assembly 45 and includes first and second mating members 49 and 50, respectively. Locking and sealing of each respective connector member in its passage 15 and 47 is effected by means of O-rings 16. In this regard, therefore, the assembly 45 operates identically with the assembly 10.

Any liquid having suitable insulative and hygroscopic properties, together with appropriate viscosity, may be used as the compound 33 irrespective of its coefficient of thermal expansion. In this respect, the bleed hole 34 also operates to relieve pressure within the chamber 13 caused by a change of liquid volume relative to the volume of the chamber resulting from an environmental temperature change. Marine temperatures are relatively stable, but large changes in temperature can and do occur in equipment during transit, especially in the Arctic. For example, the temperature may be high within the hold of a ship or aboard an aircraft, but extremely low in the open environment.

Figure 3:
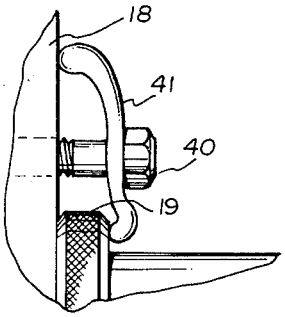
FIG. 3 is a partial side elevation view of the embodiment of FIG. 1 showing another means for mounting the connector assembly.
Figure 4:
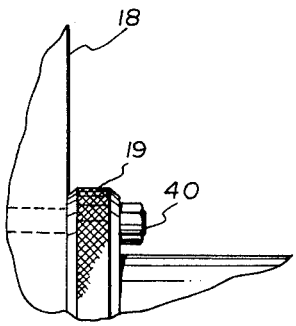
FIG. 4 is a partial side elevation view of the embodiment of FIG. 1 showing still another means for mounting the connector assembly.

Reference to FIGS. 3 and 4 shows alternate modes of mounting the connector assembly 10 on a pressure hull 18. In FIG. 3 a clamp arrangement is used to hold the connector assembly 10 in position. It will be seen that the clamp comprises a bolt 40 and a clamping dog 41. One end of the dog 41 acts as a fulcrum and the other end bears against a side of the flange portion 19. In FIG. 4, the mounting arrangement comprises a bored hole (not shown) through the flange portion 19 together with a bolt 40.

In any of the described mounting arrangements, of which the foregoing are only a sample, the spigot 20 and the through hole 25 may be threaded. Alternatively, in the embodiments of FIGS. 3 and 4, the spigot 20 may be provided unthreaded and may be used only to protect the electrical contacts 26 and to operate as a locating dowel. In the event that the spigot 20 is threaded, the rim of the flange portion 19 is notched, as may be seen in FIG. 1, to permit use of a lug wrench (not shown) to rotate the housing 12 and to engage the threads 24 of the spigot 20 with corresponding threads in the hole 25.

An extended life span for either the assembly 10 or assembly 45 is assured by fabricating the housing and cap from materials suitable for use in a hostile pressurized environment, including marine and corrosive gas environments. A number of materials are suitable, such as stainless steel, monel, and anodized aluminum to name a few. In addition, some plastics materials that are rigid and impact resistant may be used to good advantage.

In general, the same material is used for the housing and cap as is used in the pressure hull 18. Monel has, however, been used successfully with steel pressure hulls, and anodized aluminum with aluminum pressure hulls.

What I claim is:

1. A housing for a corrosion-proof electrical connector having first and second mating members interconnecting electrical conductors in a pressurized environment, the housing comprising:

container means having walls defining a substantially liquid-tight, rigid chamber adapted to receive the electrical connector, a closed end including a first passage therethrough for admitting a first conductor to the first mating member, and a cappable open end;

a rigid cap closing the open end, the cap including a second passage therethrough for admitting a second conductor to the second mating member;

locking means disposed on the cap and closed end for retaining said members in locked mating relation when the open end is capped;

a dielectric liquid substantially inert to the environment and filling the rigid chamber to at least immerse the mating portions of said members; and a bleed hole disposed in the housing for directly communicating the environment to said liquid for pressure balancing the housing and pressure sealing the immersed portions of said members.

2. A housing as claimed in claim 1, further comprising sealing means disposed on the cap and closed end for sealing the conductors in the passages.

3. A housing as claimed in claim 2, wherein the bleed hole is dimensioned to retain under surface tension thereof.

4. A housing as claimed in claim 3, further comprising means for advancing the cap a predetermined distance towards the closed end to engage said members in mating relation.

5. A housing as claimed in claim 4, wherein the means for advancing the cap comprises corresponding threaded portions on the cap and said walls defining the open end.

6. A housing as claimed in claim 5, wherein the liquid has a specific gravity greater than that of water.

7. A housing as claimed in claim 5, wherein the liquid has a specific gravity less than that of water.

8. A corrosion-proof electrical connector assembly for interconnecting electrical conductors in a pressurized environment, the assembly comprising:

an electrical connector having first and second mating members;

container means having walls defining a substantially liquid-tight, rigid chamber adapted to receive the electrical connector, a closed end including a first passage therethrough for admitting a first conductor to the first mating member, and a cappable open end;

a rigid cap closing the open end, the cap including a second passage therethrough for admitting a second conductor to the second mating member;

locking means disposed on the cap and closed end for retaining said members in locked mating relation when the open end is capped;

a dielectric liquid substantially inert to the environment and filling the rigid chamber to at least immerse the mating portions of said members; and a bleed hole disposed in one of said walls and cap for directly communicating the environment to said liquid for pressure balancing the assembly and pressure sealing the immersed portions of said members.

9. An assembly as claimed in claim 8, further comprising sealing means disposed on the cap and closed end for sealing the conductors in the passages.

10. An assembly as claimed in claim 9, wherein the bleed hole is dimensioned to retain the liquid under surface tension thereof.

11. An assembly as claimed in claim 10, further comprising means for advancing the cap a predetermined distance towards the closed end to engage said members in mating relation.

12. An assembly as claimed in claim 11, wherein the means for advancing the cap comprises corresponding threaded portions on the cap and said walls defining the open end.

13. An assembly as claimed in claim 12 for establishing an electrical connection through a pressure hull separating said environment from a lower pressure environment, wherein:

the external surface of the closed end is adapted to be mounted on the high pressure side of the hull, said hull having a through opening in alignment with the first passage; and the first mating member includes a feed-through portion extending into said hull.

14. An assembly as claimed in claim 13, wherein the external surface of the closed end includes a flange portion which abuts a mounting surface of said hull.

15. An assembly as claimed in claim 14, further comprising sealing means between the flange portion and the hull mounting surface to prevent intrusion of the higher pressure environment into said through opening.

16. An assembly as claimed in claim 15 wherein the closed end further includes an outwardly extending spigot through which the first passage extends.

17. An assembly as claimed in claim 16, wherein said sealing means comprises at least one resilient ring.

18. An assembly as claimed in claim 17, wherein said liquid is petroleum jelly.

19. An assembly as claimed in claim 17, wherein said liquid is a fluorosilicon liquid.

20. An assembly as claimed in claim 18, further comprising means for securing said connector to the hull.

21. An assembly as claimed in claim 19 further comprising means for securing said connector to the hull.

22. An assembly as claimed in claim 20 wherein said means for securing comprises a threaded portion within the through opening in the hull and a corresponding threaded portion on the spigot.

23. An assembly as claimed in claim 22 wherein the first member of the connector is an integral portion of the closed end.

* * * * *